United States Patent [19]

Peterson

[11] Patent Number: 4,993,548

[45] Date of Patent: Feb. 19, 1991

[54] CARRYING CASE

[76] Inventor: Vernon L. Peterson, P.O. Box 1096, Bismarck, N. Dak. 58502

[21] Appl. No.: 535,748

[22] Filed: Jun. 8, 1990

[51] Int. Cl.[5] ..... B65D 61/00

[52] U.S. Cl. ..... 206/315.1; 206/315.9; 224/919

[58] Field of Search ..... 206/315.1, 315.9; 273/56; 224/919

[56] References Cited

U.S. PATENT DOCUMENTS 4,214,684 7/1980 Galowitz ..... 206/315.9

*Primary Examiner*—William I. Price

*Attorney, Agent, or Firm*—Zarley, McKee, Thomte, Voorhees & Sease

[57] ABSTRACT

A carrying case comprising a bottom member having four openings formed in its upper surface adapted to receive the lower ends of four game stakes therein. The bottom member is also provided with a central cavity positioned between the four stake openings to permit the storage of a measuring cord therein and to partially receive the lower portion of the lowermost ball of four balls stacked one upon the other within the confines of the four stakes. A top member is joined to the bottom member by a pair of rubber cords and has openings formed in its underside adapted to receive the upper ends of the game stakes. The top member also is provided with a central cavity adapted to partially receive the upper portion of the uppermost ball.

5 Claims, 4 Drawing Sheets

CARRYING CASE

BACKGROUND OF THE INVENTION

This invention relates to a carrying case, and more particularly to a carrying case for the components of a game including stakes, balls and a measuring cord.

I have invented a novel game and have entitled the same "CRO-SHOE". The game consists of two pairs of stakes with each pair being located a predetermined distance apart from one another. Four wooden balls are utilized in the game. Much like croquet, it is difficult to store the components of the game or transport the components of the game from one location to another.

It is therefore a principal object of the invention to provide a carrying case for a game.

Still another object of the invention is to provide a carrying case designed to accommodate at least four stakes, four balls and a measuring cord.

Still another object of the invention is to provide a game carrying case including upper and lower case portions which are joined together by a pair of elastic cords designed to maintain the game components in the carrying case.

Still another object of the invention is to provide a carrying case for a game which is economical of manufacture, durable in use and refined in appearance.

SUMMARY OF THE INVENTION

Figure 1:
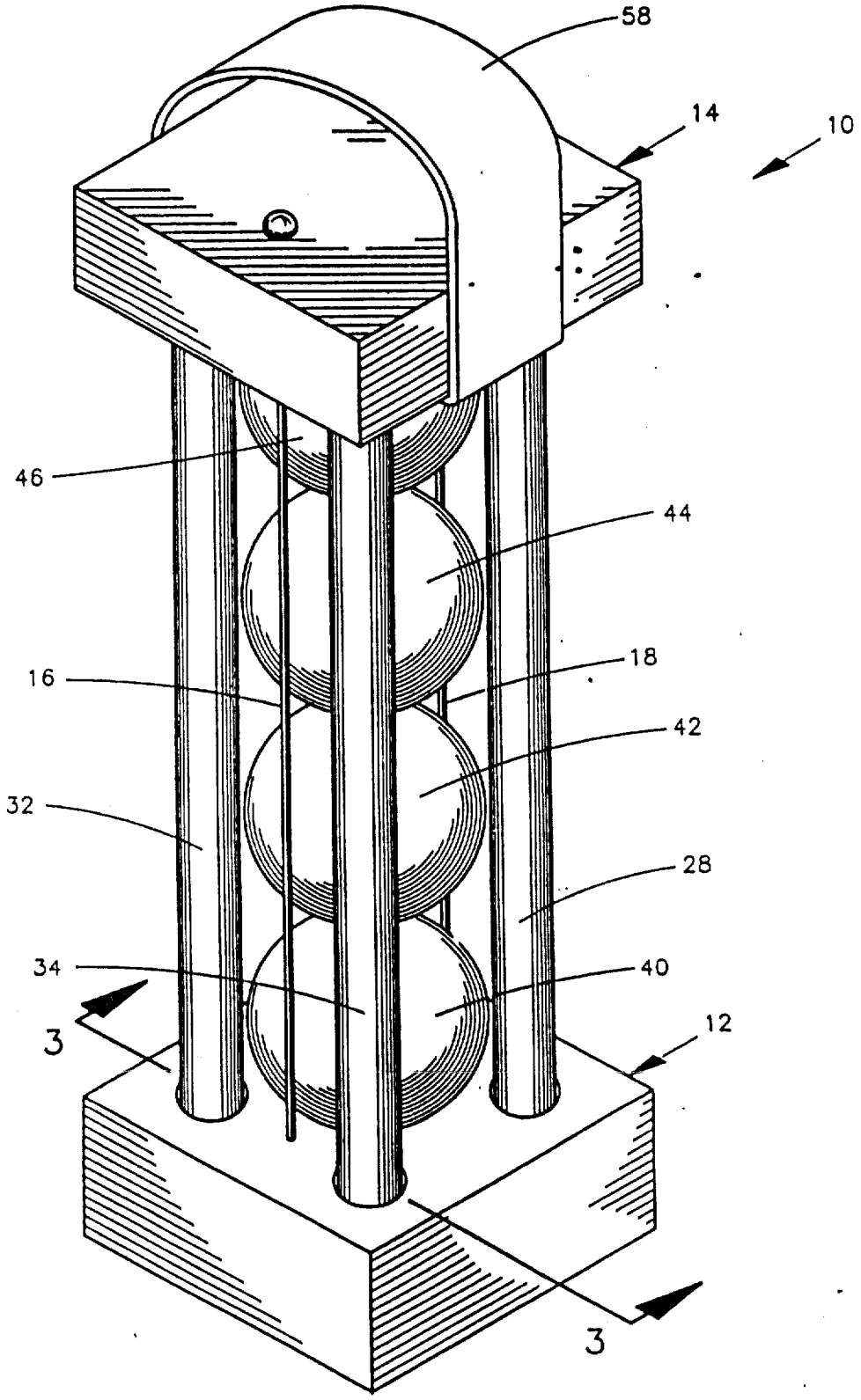
FIG. 1 is a perspective view of the carrying case of this invention with the game pieces therein.
Figure 2:
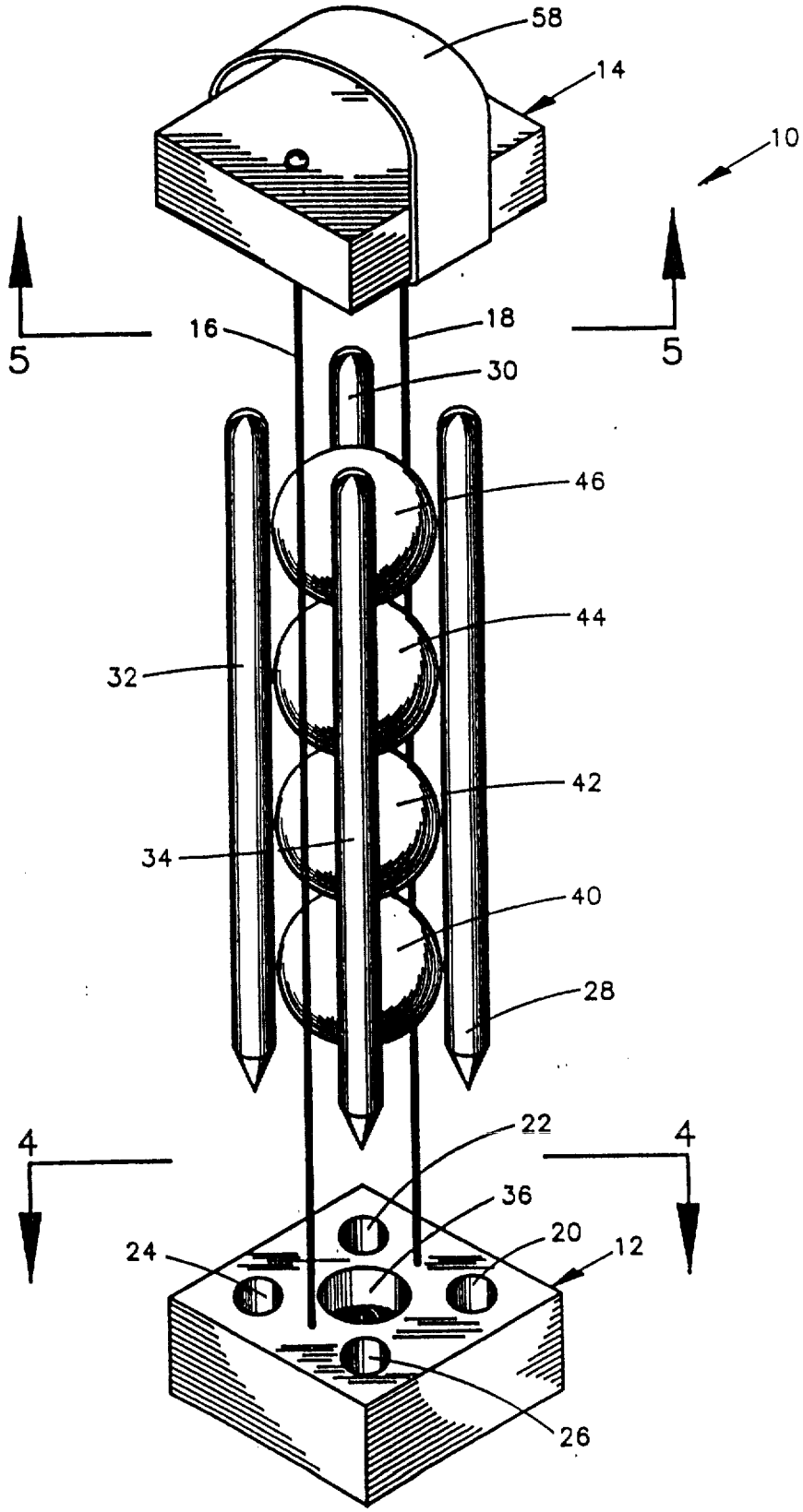
FIG. 2 is an exploded perspective view of the carrying case of this invention.
Figure 3:
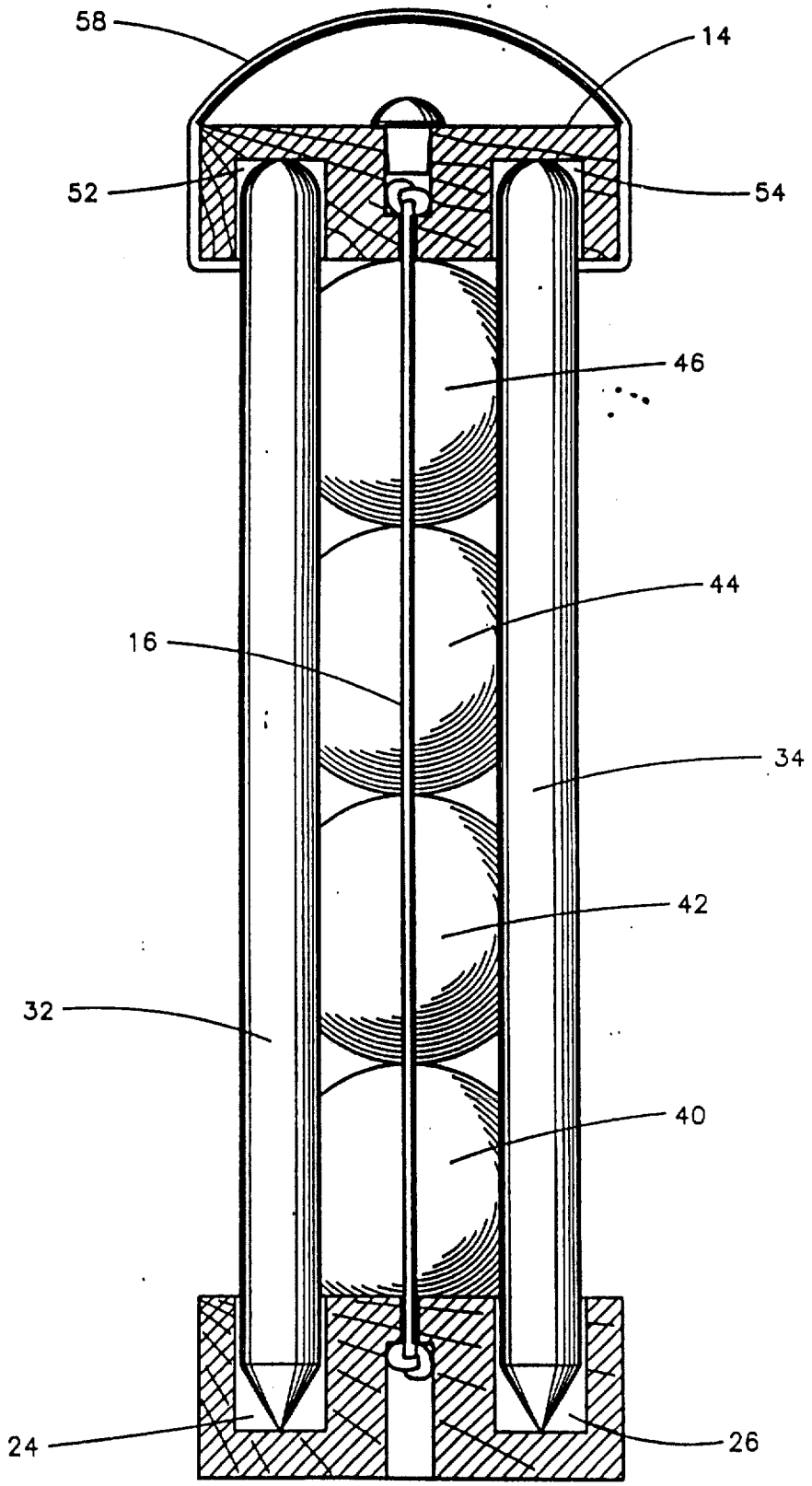
FIG. 3 is a sectional view as seen on lines 3-3 of FIG. 1.
Figure 4:
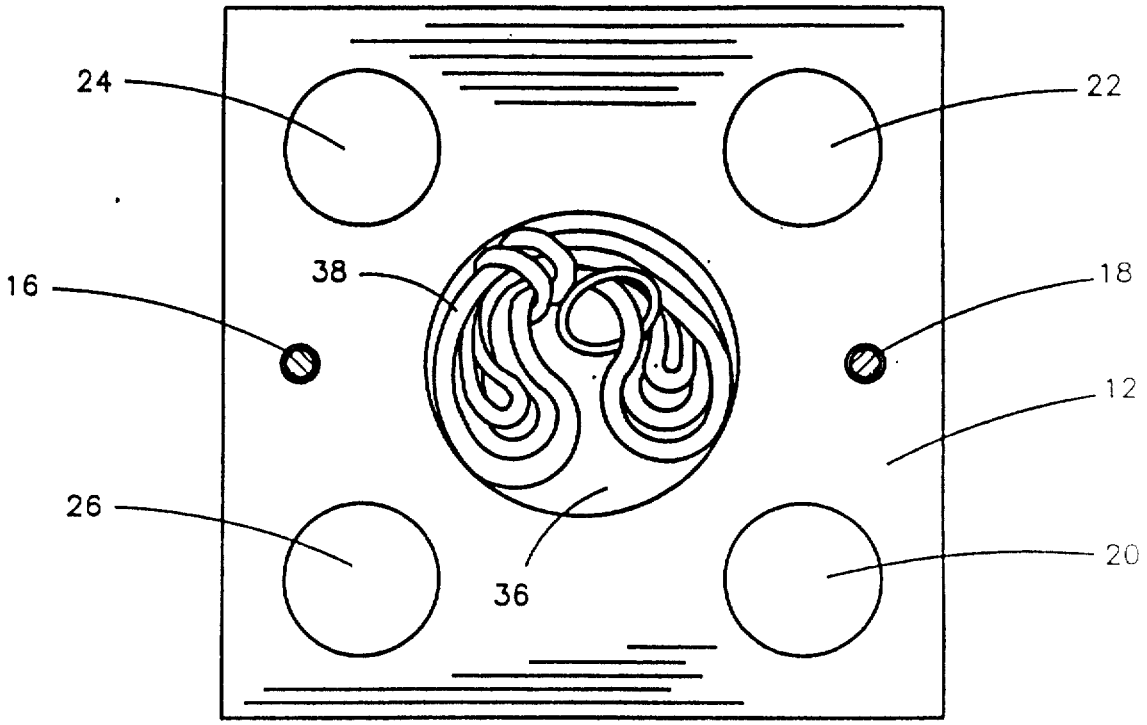
FIG. 4 is a sectional view as seen on lines 4-4 of FIG. 2.
Figure 5:
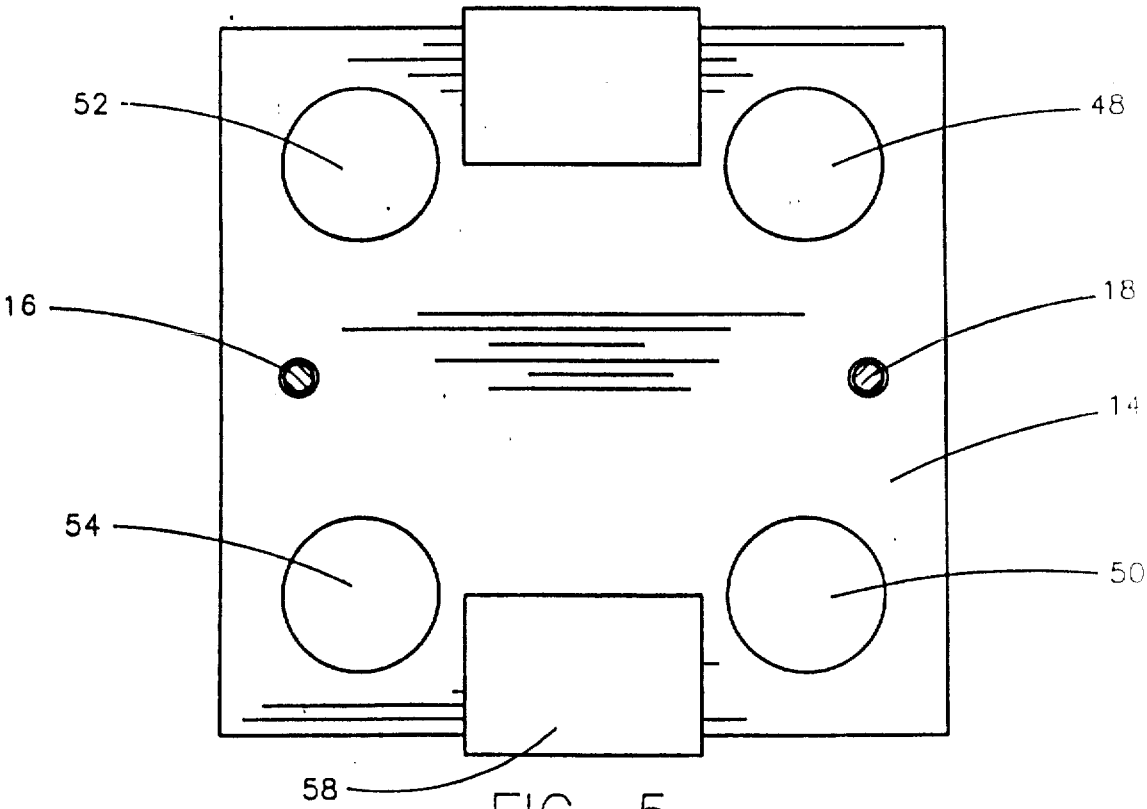
FIG. 5 is a sectional view as seen on lines 5-5 of FIG. 2.

The carrying case of this invention comprises a base member having four spaced-apart openings formed therein which are adapted to receive the lower ends of stakes utilized in the game. A centrally-disposed cavity is also provided in the base member to permit a measuring cord to be inserted therein for storage. A plurality of vertically-disposed balls are positioned between the stakes, with the lowermost ball being partially received by the cavity in the base member. A top member is positioned over the upper end of the stakes and balls and has openings formed therein for receiving the same. The top and base members are interconnected by a pair of rubber or elastic cords which urge the base and top members together to hold the stakes and balls between the top and base members.

DESCRIPTION OF THE PREFERRED EMBODIMENT

The carrying case of this invention is referred to generally by the reference numeral 10 and includes a base member 12 connected to a top member 14 by a pair of rubber or elastic cords 16 and 18.

Base member 12 is provided with four openings 20, 22, 24 and 26 extending downwardly into the upper surface thereof adapted to receive the lower ends of stakes 28, 30, 32 and 34 respectively. Base member 12 is provided with a centrally-disposed cavity or compartment 36 extending downwardly into the upper surface thereof for storing a measuring cord 38 therein. Cavity 36 is also designed to partially receive the lower end of ball 40. Balls 42, 44 and 46 are stacked on top of ball 40 as seen in the drawings.

Top member 14 is provided with openings 48, 50, 52 and 54 formed in the lower surface thereof adapted to receive the upper ends of the stakes 28, 30, 32 and 34 respectively. Although not necessary, it is preferred that the underside of top member 14 also have a cavity formed therein adapted to partially receive the upper surface of the uppermost ball 46. Top member 14 is also provided with a handle or carrying strap 58.

Thus, when the stakes and balls are positioned as illustrated in FIG. 1, the elastic or rubber cords 16 and 18 urge the top member 14 and bottom member 12 towards one another to maintain the stakes and balls in position. When it is desired to play the game, top member 14 and base member 12 are separated against the resiliency of the rubber cords 16 and 18 so that the stakes and balls may be removed therefrom. The measuring cord is also then removable from the cavity 36.

Thus it can be seen that a novel carrying case has been provided which may be termed a self-contained game since all of the components of the game are held by the carrying case.

I claim:

1. In combination, a base member having an upper surface and a lower surface, said base member having a centrally-disposed cavity formed therein extending downwardly thereinto for partially receiving the underside of a ball, said base member having at least four spaced-apart stake openings formed therein extending downwardly thereinto from the upper surface thereof, a plurality of elongated stakes having upper and lower ends, the lower end of each of said stakes being received by one of said stake openings, a top member positioned above said base member and having an upper surface and a lower surface, said lower surface of said top member having a plurality of spaced-apart stake openings formed therein which receive the upper ends of said stakes, a lower ball member positioned in the cavity on said base member between said stakes, a plurality of vertically disposed balls positioned on said lower ball member between said stakes with said stakes maintaining said vertically disposed condition of said balls, and a plurality of elongated elastic members secured to and extending between said base member and said top member for normally urging said base member and said top member towards one another to maintain said stakes in engagement with said stake openings in said base and top members.

2. The combination of claim 1 wherein four stake openings are provided in each of said base and top members.

3. The combination of claim 1 wherein said base member is provided with a storage compartment positioned below said cavity.

4. The combination of claim 1 wherein said lower surface of said top member has a centrally-disposed cavity formed therein for partially receiving the upper portion of the ball positioned therebelow.

5. The carrying case for a game including at least four game stakes, and a plurality of balls, comprising, a base member having an upper surface and a lower surface, said base member having a centrally-disposed cavity formed therein extending downwardly thereinto for partially receiving the underside of a ball, said base member having at least four spaced-apart stake openings formed therein extending downwardly thereinto from the upper surface thereof, a plurality of elongated stakes having upper and lower ends, the lower end of each of said stakes being received by one of said stake openings, a top member positioned above said base member and having an upper surface and a lower surface, said lower surface of said top member having a plurality of spaced-apart stake openings formed therein which receive the upper ends of said stakes, a lower ball member positioned in the cavity on said base member between said stakes, a plurality of vertically disposed balls positioned on said lower ball member between said stakes with said stakes maintaining said vertically disposed condition of said balls, and a plurality of elongated elastic members secured to and extending between said base member and said top member for normally urging said base member and said top member towards one another to maintain said stakes in engagement with said stake openings in said base and top members.

* * * * *